US008729800B2

(12) United States Patent
Welters

(10) Patent No.: US 8,729,800 B2
(45) Date of Patent: May 20, 2014

(54) HIGH INTENSITY DISCHARGE LAMP WITH EXTERNAL ANTENNA

(75) Inventor: Wilhelmus Johannes Jacobus Welters, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/395,140

(22) PCT Filed: Sep. 7, 2010

(86) PCT No.: PCT/IB2010/054007

§ 371 (c)(1), (2), (4) Date: Mar. 9, 2012

(87) PCT Pub. No.: WO2011/030278

PCT Pub. Date: Mar. 17, 2011

(65) Prior Publication Data

US 2012/0169224 A1 Jul. 5, 2012

(30) Foreign Application Priority Data

Sep. 10, 2009 (EP) ..... 09169968

(51) Int. Cl.
*H01J 11/00* (2012.01)
*H01J 17/00* (2006.01)

(52) U.S. Cl.
USPC ..... 313/573; 313/567

(58) Field of Classification Search
None
See application file for complete search history.

(56) References Cited

U.S. PATENT DOCUMENTS

| | | | | |
|---|---|---|---|---|
| 5,510,676 | A | 4/1996 | Cottaar | |
| 5,541,480 | A | 7/1996 | Renardus | |
| 6,538,377 | B1 | 3/2003 | Scott | |
| 2011/0115371 | A1* | 5/2011 | Steere et al. | 313/594 |

FOREIGN PATENT DOCUMENTS

| | | | |
|---|---|---|---|
| EP | 0160445 | A2 | 11/1985 |
| EP | 0215524 | A1 | 3/1987 |
| EP | 0587238 | A1 | 3/1994 |
| EP | 1355345 | A1 | 10/2003 |
| GB | 2083281 | A1 | 3/1982 |
| WO | 0137319 | A1 | 5/2001 |
| WO | 2005088675 | A2 | 9/2005 |
| WO | 2006046175 | A2 | 5/2006 |
| WO | 2010004472 | A2 | 1/2010 |

* cited by examiner

*Primary Examiner* — Natalie Walford

(57) ABSTRACT

The invention provides a high intensity discharge lamp comprising a ceramic discharge vessel having sealed first and second end plugs and an external electrical antenna, which is used as "active" antenna for facilitating ignition of the high intensity discharge lamp. The discharge vessel encloses a discharge volume and comprises two electrodes and contains a filling.

12 Claims, 5 Drawing Sheets

HIGH INTENSITY DISCHARGE LAMP WITH EXTERNAL ANTENNA

THE FIELD OF THE INVENTION

The present invention relates to a high intensity discharge lamp, such as a high pressure metal halide lamp or a high pressure sodium lamp, comprising a ceramic discharge vessel, which discharge vessel encloses a discharge volume, comprises two electrodes, and contains a filling.

BACKGROUND OF THE INVENTION

Metal halide lamps are known in the art and are described, for example, in EP0215524, WO2006/046175 and WO05088675. Such lamps operate under high pressure and comprise ionizable gas fillings of, for example, NaI (sodium iodide), TlI (thallium iodide), $CaI_2$ (calcium iodide), and/or $REI_n$. $REI_n$ refers to rare earth iodides. Such lamps, when having a ceramic discharge vessel, are also indicated as ceramic discharge metal (CDM) halide lamps.

Characteristic rare earth iodides for metal halide lamps are $CeI_3$, $PrI_3$, $NdI_3$, $DyI_3$, and $LuI_3$. An important class of metal halide lamps are ceramic discharge metal halide lamps (CDM-lamps), which are described in the above-mentioned documents.

WO05088675 for instance discloses a metal halide lamp comprising a discharge vessel surrounded with clearance by an outer envelope and having a ceramic wall which encloses a discharge space filled with a filling comprising an inert gas, such as xenon (Xe) and an ionizable salt, said discharge space accommodating two electrodes arranged such that their tips have a mutual interspacing so as to define a discharge path between them, and a special feature of the ionizable salt being that said ionizable salt comprises NaI, TlI, $CaI_2$ and X-iodide, wherein X is selected from the group comprising rare earth metals. In a specific embodiment of WO05088675, X is one or more elements selected from the group comprising Ce, Pr, Nd.

High intensity discharge lamps may also be metal vapour-based, such as sodium-based (also indicated as high pressure sodium (HPS)). Such lamps are for instance described in GB1582115, GB1587987 and GB2083281. GB1587987 for instance describes a high-pressure sodium vapour discharge lamp provided with a discharge tube which solely contains sodium, mercury and xenon, the sodium vapour pressure in the operating condition of the lamp being between 100-200 Torr, and the xenon pressure at 300 K being between 50 and 1000 Torr (1 Torr=133 Pa or 0.00133 bar).

The use of auxiliary means for initiating the discharge within the discharge vessel of discharge lamps is for instance described in U.S. Pat. No. 5,541,480. This document describes a high-pressure discharge lamp provided with a discharge vessel with a ceramic wall which has an outer surface on which a metallic coating is present. The coating is a metal layer sintered on the ceramic wall, which sintering process takes place during sintering of the discharge vessel so as to achieve translucence. The metal layer is a strip extending along the length dimension of said discharge vessel to facilitate ignition of a discharge within said discharge vessel. The discharge vessel includes a pair of opposing discharge electrodes, each situated at an opposing respective end thereof, and the metal layer may further include a substantially closed circumferential ring extending at the axial location of each electrode and in contact with said strip.

SUMMARY OF THE INVENTION

The application of a floating antenna, such as described in U.S. Pat. No. 5,541,480, may improve the ignition of the lamp, compared to systems without antenna, but may still require a relatively high ignition voltage. As a consequence, the noble gas pressure cannot be as high as desired for optimal lamp performance.

It is therefore suggested to connect the antenna to one of the electrodes. However, it has been found that this is not easy. During the production stage, the (floating) antenna is preferably applied to the discharge vessel before the current lead-through conductors (which are in electrical contact with the respective electrodes) are sealed into the end plugs of the discharge vessel. Since a sealing material is used to seal, physical contact between the antenna (more precisely, a (first) end part of the antenna) and the current lead-through conductor may be difficult or even impossible. It further appears that controlled positioning of the end parts of the antenna as close as possible, such as in the order of a few micron or less, to the current lead-through conductors (thus before sealing) is also difficult or even impossible, especially in large scale production processes.

Hence, it is desirable to provide an alternative high intensity discharge lamp, which preferably obviates one or more of the above drawbacks.

To this end, the invention provides in an aspect a high intensity discharge lamp (herein also indicated as "lamp" or "high intensity discharge lamp", etc.), comprising a ceramic discharge vessel (herein also indicated as "discharge vessel" or "vessel") having sealed first and second end plugs and an external electrical antenna (herein also indicated as "antenna"), wherein the discharge vessel encloses a discharge volume, comprises first and second electrodes, and contains a filling;

the end plugs enclose first and second current lead-through conductors, which current lead-through conductors are in electrical contact with the electrodes, and which current lead-through conductors comprise first and second metal portions extending to the exterior of the ceramic discharge vessel through first and second end plug openings;

the end plug openings are sealed with first and second sealing glasses (also indicated as "seals" or "sealings") enclosing at least part of the metal portions;

the external electrical antenna extends over at least part of the external surface of the ceramic discharge vessel and over at least part of the external surface of the first end plug, especially a sintered tungsten track, wherein the shortest distance ($L_{A-M}$) between a first end of the electrical antenna and the first metal portion is in the range of 0.1-5 mm, and wherein the electrical resistance of the first sealing glass (10*a*) between the first end of the electrical antenna and the first metal portion is <100 kΩ.

Such a halide lamp, especially the external electrical antenna thereof, may be produced in a controlled way. Further, such a discharge lamp may have a larger noble gas pressure than state of the art discharge lamps, which may provide better light-technical properties, while the discharge is still initiated relatively easily. In such lamps, the antenna may be electrically connected with the current lead-through conductors, while still being at a spatial distance from said current lead-through conductors. Thus, while the antenna is not in physical contact with the current lead-through conductors (especially the metal portion thereof extending to the exterior of the ceramic discharge), there is electrical contact, due to the choice of an electrically conductive sealing glass (i.e. a sealing glass closes the gap between the current lead-through conductors and the end plug opening and creates a conducting barrier between the first end of the antenna and the first current lead-through conductor). A higher noble gas pressure may have the effects of: 1) higher efficacy (for instance for HPS lamps, depending on the lamp type, the increase may be between 5 and 15%), and 2) better maintenance. A higher noble gas pressure, such as a higher Xe pressure, may reduce blackening due to the evaporation and deposition of W from the electrode(s) onto the arc tube wall.

For most lamps (both HPS and CDM) a reliable ignition voltage may be somewhere around 3 kV. With the invention, however, the ignition voltage may be reduced by 30 to 50% (i.e. in the range of about 1.5-2 kV).

For HPS lamps, the freedom to decrease the ignition voltage may not (fully) be used, but additionally or alternatively, this extra design space may be used to increase the noble gas pressure, especially the Xe pressure (see also above), to a level where the ignition voltage is in the same order as defined above. This may lead to lamps with better light-technical properties.

For CDM lamps, the reduction in ignition voltage may be used to improve the ignition reliability (i.e. not increase the filling gas pressure). A possible advantage for CDM could be to make the lamp "hot-restrike". This means that the lamp can be ignited again during cooling down, when the ignition voltage is higher than in the cold state due to the presence of a high Hg pressure inside the still hot lamp.

Herein, the terms "first" and "second" refer to respective parts that may in some embodiments be substantially identical. For instance, the first and second current lead-through conductors and the first and second end plugs and the first and second sealing glasses may be substantially identical. Further, the terms "first" and "second", when referring to specific items, do in general not refer to a specific order in which the device comprising the items may have been assembled. In contrast, the first and second ends of the antenna are in principle not identical, since the first end indicates the end part that is in electrical contact with the first (metal portion of the) current lead-through conductor and the second end part indicates the part of the antenna most remote from this first end part, but which second end part is not in electrical contact with the second (or first) current lead-through conductor. Between this second end part and the electrode, within the discharge vessel, the discharge may be initiated. The shortest distance between the (second end part of the) antenna and the electrode may vary in dependence on the type of lamp and the arrangement of the antenna (and its optional circumferential part (see also below)) and may for instance be in the range of 0.8-10 mm. This distance comprises the gas in the discharge vessel and the discharge vessel wall.

In a specific embodiment, the first metal portion comprises niobium. This material has a coefficient of thermal expansion that may correspond to that of the ceramic discharge vessel. Niobium is the preferred metal, but also molybdenum, iridium, rhenium an alloy of one or more of niobium, molybdenum, iridium, and rhenium can be used. Optionally, also tungsten or platinum may be applied for the metal portion(s).

The antenna may be a metal layer on the ceramic wall; the metal layer may be sintered on the ceramic wall, as described in U.S. Pat. No. 5,541,480, which sintering process may in an embodiment take place during sintering of the discharge vessel. Especially, the electrical antenna comprises a sintered tungsten track. Such a tungsten track may be provided on the exterior surface of the discharge vessel and on one of the end plugs, such as described in U.S Pat. No. 55,414,180, which is incorporated herein by reference. The antenna in electrical contact with one electrode (or current lead-through conductor) is herein also indicated as "active antenna".

A number of glasses may be used, as long as the electrical resistance between the first end part of the antenna and the current lead-through conductor is within the indicated range (i.e. allowing "electrical contact"). In a specific embodiment, the first sealing glass comprises an aluminum oxide dysprosium oxide silicium oxide glass. In another embodiment, the first sealing glass comprises a barium oxide magnesium oxide aluminum oxide glass.

Especially, the shortest distance ($L_{A-M}$) between the first end of the electrical antenna and the first metal portion may be in the range of 0.1-3 mm, such as 0.3-0.8 mm. This may be a good compromise between processing demands and conduction. Especially, the electrical resistance of the first sealing glass between the first end of the electrical antenna and the first metal portion is 1Ω-50 kΩ, such as 3Ω-50 kΩ, especially 5Ω-10 kΩ. Glasses that may fulfill such a criterion are amongst others the above mentioned aluminum oxide dysprosium oxide silicium oxide glass and barium oxide magnesium oxide aluminum oxide glass. The resistance of the sealing glass may be dependent on its phase. As long as there is an amorphous (=glass-like) basis throughout the sealing portion, the resistance will be sufficiently low. This glass phase preferably touches both the antenna and the current lead-through conductor (such as a Nb feedthrough). Crystalline parts of the sealing portion have a much higher electrical resistance. In the glass there can be crystalline portions, but as long as they do not interrupt the glass basis from antenna to Nb-feedthrough that is not a problem. The sealing glass and electrical antenna are especially arranged in such a way that the first end of the electrical antenna is in physical contact with, such as embedded in, the sealing glass.

In a specific embodiment, the high intensity discharge lamp is a high pressure sodium (HPS) discharge lamp, the filling comprises sodium, the discharge vessel further comprises xenon, and the xenon pressure is at least 250 Torr, preferably 270-600 Torr, such as 300-550 Torr. The current lamps in general have a xenon pressure that is lower. Current lamps with more Xe in general will have ignition problems when used on regular gear according to IEC 60662. The filling may comprise an amalgam of mercury and sodium. The filling may also be mercury free. Hence, when applying regular gear according to IEC 60662, the above indicated Xe pressures may be applied in an HPS lamp.

In yet another embodiment, the high intensity discharge lamp is a high pressure metal halide vapour lamp wherein, in an embodiment, the filling comprises sodium, thallium, calcium and optionally one or more elements selected from the group of rare earth metals, scandium, yttrium, lithium, gallium, aluminum, indium, zinc, and tin. In another embodiment, the filling comprise at least one element from each group a) alkali metal halides, b) indium (and/or) or thallium halide, and c) rare earth metal halides, and optionally d) one element from the group of alkaline earth metal halides. The metals are especially added as iodides. Lithium iodide may be used to reduce the green color component; gallium iodide may be used to provide lamps with a relatively higher color temperature ("colder" light); aluminum iodide may for instance be used to buffer impurities; indium iodide may also be used to provide lamps with a relatively higher color temperature ("colder" light); zinc iodide may be used in those instances where no mercury (iodide) is desired; and tin iodide may be used to provide lamps with relatively lower color temperatures ("warmer" light). In an embodiment, the filling comprises one or more metal iodides selected from the group consisting of Cs, Rb, K, Sr, Nd, Yb, La, Li, Mg, Sc, Y, Pr, Sm, Eu, Gd, Tb, Dy, Ho, Tm, and Lu. In the art the term "(salt) filling" is sometimes also indicated as "ionisable gas filling" or "ionisable (salt) filling". The filling may also be mercury free.

The high intensity discharge lamp may for instance have a correlated color temperature (CCT) in the range of 2500-4500 K.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

As mentioned above, the lamp of the invention comprises a ceramic discharge vessel. This especially means that the walls of the ceramic discharge vessel preferably comprise a translucent crystalline metal oxide, like monocrystalline sapphire and densely sintered polycrystalline alumina (also known as PCA), YAG (yttrium aluminum garnet) and YOX (yttrium aluminum oxide), or translucent metal nitrides like AlN. The vessel wall may consist of one or more (sintered) parts, as known in the art (see also below).

Below, embodiments of the lamp of the invention are described with reference to FIGS. 1-3. However, the lamp of the invention is not confined to the embodiments described below and/or schematically depicted in FIGS. 1-3. Specific embodiments and principles of the invention are depicted in FIGS. 4*a*-4*d* and 5*a*-5*b* and described below.

Lamp 1 may be a high-intensity discharge lamp. In FIGS. 1-3, discharge vessels 3 are schematically depicted. The current lead-through conductors 20, 21 are sealed with two respective seals 10 (sealing fits, as known in the art). However, the invention is not limited to such embodiments.

Figure 1:
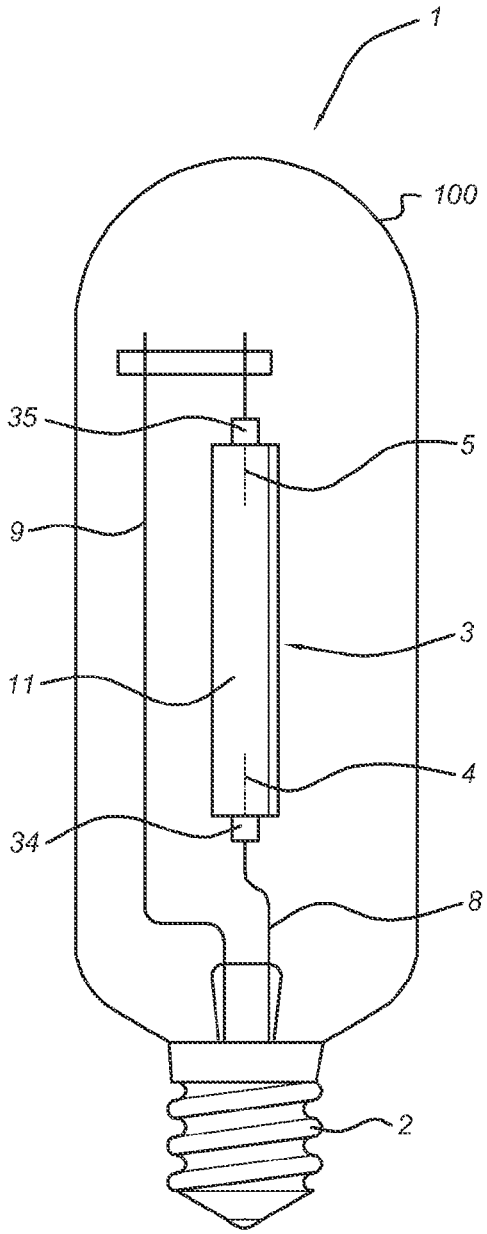
FIG. 1 schematically depicts an embodiment of a lamp according to the invention in a side elevation.
Figure 2:
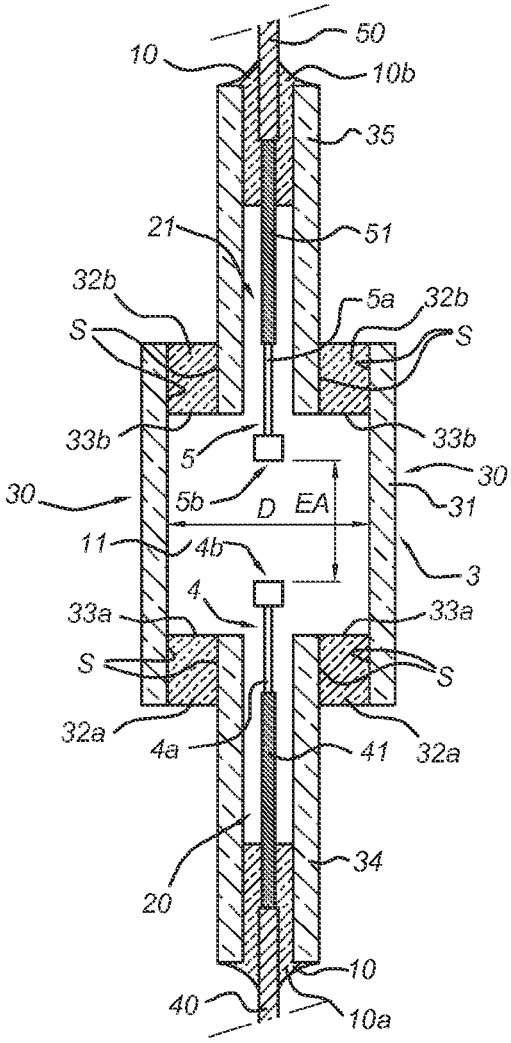
FIG. 2 schematically depicts an embodiment of the discharge vessel of the lamp of FIG. 1 in more detail.
Figure 3:
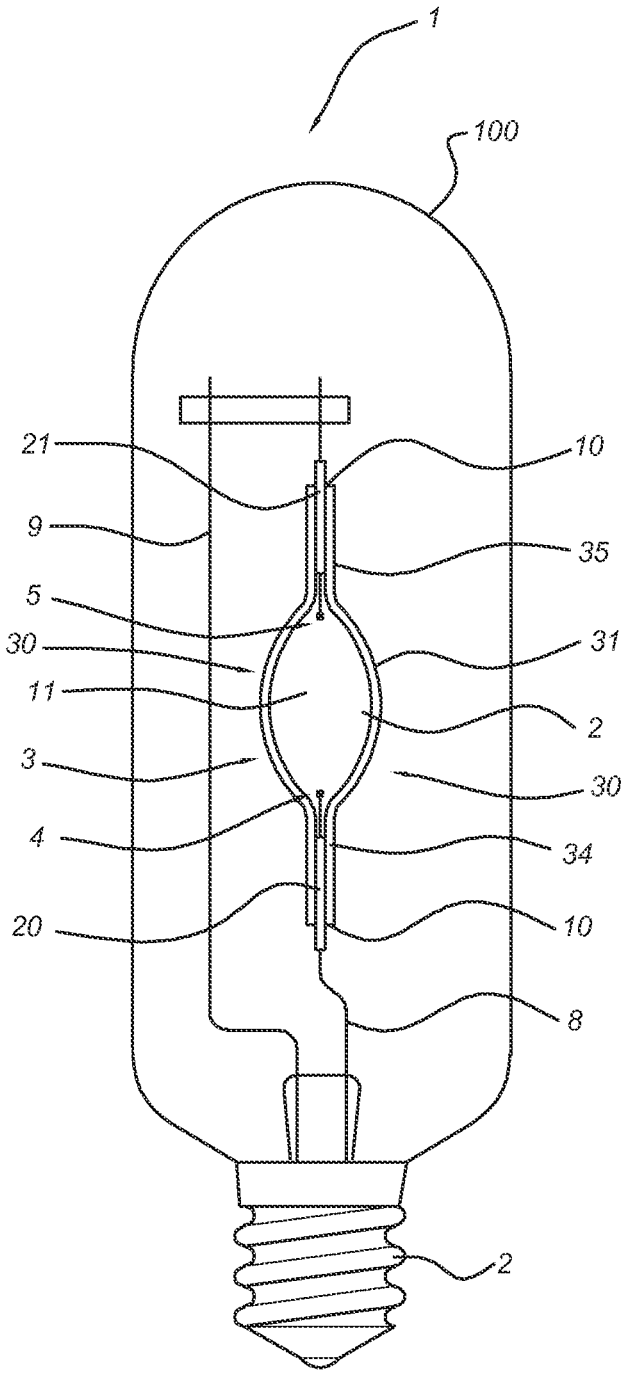
FIG. 3 schematically depicts an embodiment having an alternatively shaped discharge vessel.

Herein, specific embodiments are described in more detail, wherein both current lead-through conductors 20, 21 are sealed into discharge vessel 3 by means of seals 10 (see also FIGS. 1-3). Two electrodes 4, 5, for example tungsten electrodes, with tips 4*b*, 5*b* at a mutual distance EA (sometimes in the art also indicated as ED) are arranged in the discharge space 11 so as to define a discharge path between them. The cylindrical discharge vessel 3 may in an embodiment have an internal diameter D at least over the distance EA. Each electrode 4, 5 extends inside the discharge vessel 3 over a length forming a tip to bottom distance between the vessel wall 31 (i.e. reference signs 33*a*, 33*b* (see also below), respectively) and the electrode tip 4*b*, 5*b*. The discharge vessel 3 may be closed on either side by means of end wall portions 32*a*, 32*b* forming end faces 33*a*, 33*b* of the discharge space. The end wall portions 32*a*, 32*b* may each have an opening in which a respective ceramic projecting plug 34, 35 is fitted in a gastight manner in the end wall portion 32*a*, 32*b* by means of a sintered joint S. The discharge vessel 3 is closed by means of these ceramic (projecting) plugs 34, 35, each of which encloses, with a narrow intervening space, a current lead-through conductor 20, 21 (in general including respective components 40, 41; 50, 51, which are explained in more detail below) to the electrode 4, 5 positioned in the discharge vessel 3 and is connected to this conductor in a gastight manner by means of a melting-ceramic joint 10 (further indicated as seal 10) at an end remote from the discharge space 11. Here, the ceramic discharge vessel wall 30 comprises vessel wall 31, ceramic (projecting) plugs 34, 35, and end wall portions 32*a*, 32*b*.

The plugs 34, 35 (or end plugs 34, 35) are herein also indicated as respectively first and second end plugs.

The discharge vessel 3 is surrounded by an outer bulb 100 which is provided with a lamp cap 2 at one end. A discharge will extend between the electrodes 4 and 5 when the lamp 1 is in operation. The electrode 4 is connected via a current conductor 8 to a first electrical contact forming part of the lamp cap 2. The electrode 5 is connected via a current conductor 9 to a second electrical contact forming part of the lamp cap 2.

The ceramic (projecting) plugs 34, 35 each narrowly enclose a current lead-through conductor 20, 21 of a relevant electrode 4, 5 having electrode rods 4*a*, 5*a* which are provided with tips 4*b*, 5*b*, respectively. Current lead-through conductors 20, 21 enter discharge vessel 3. In an embodiment, the current lead-through conductors 20, 21 may each comprise a halide-resistant portion 41, 51, for example in the form of a Mo—$Al_2O_3$ cermet, and a portion 40, 50 which is fastened to a respective end plug 34, 35 in a gas tight manner by means of seals 10. Seals 10 extend some distance, for example approximately 1-5 mm, over the Mo cermets 41, 51 (during sealing, ceramic sealing material penetrates into the free space within the respective end plugs 34, 35). It is possible for the parts 41, 51 to be formed in an alternative manner instead of from a Mo—$Al_2O_3$ cermet. Other possible constructions are known, for example, from EP0587238 (incorporated herein by reference, wherein a Mo coil-to-rod configuration is described). A particularly suitable construction was found to be a halide-resistant material. The parts (or portions) 40, 50 are made from a metal whose coefficient of expansion corresponds very well to that of the end plugs 34, 35. Niobium (Nb) is chosen, for example, because this material has a coefficient of thermal expansion corresponding to that of the ceramic discharge vessel 3.

The current lead-through conductors 20, 21 are herein further also indicated as first and second current lead-through conductors 20, 21. Electrodes 4, 5 are herein also indicated as first and second electrode, respectively. The seals (or sealings or sealing glasses) 10 at the respective end plugs 34, 35 are herein also indicated as first seal 10*a* and second seal 10*b*, respectively. The metal portions 40, 50 are herein also indicated as first and second metal portions 40, 50.

FIG. 3 shows another embodiment of the lamp according to the invention. Lamp parts corresponding to those shown in FIGS. 1 and 2 have been given the same reference numerals. The discharge vessel 3 has a shaped wall 30 enclosing the discharge space 11. The shaped wall 30 forms an ellipsoid in the case shown here. Compared with the embodiment described above (see also FIG. 2), the wall 30 is a single entity, in fact comprising wall 31, respective end plugs 34, 35, and end wall portions 32*a*, 32*b* (shown as separate parts in FIG. 2). A specific embodiment of such a discharge vessel 3 is described in more detail in WO06/046175. Alternatively, other shapes, like for example spheroid, are equally possible.

Herein, wall 30, which in the embodiment schematically depicted in FIG. 2 may include ceramic (projecting) plugs 34, 35, end wall portions 32*a*, 32*b*, and wall 31, or wall 30, as schematically depicted in FIG. 3, is a ceramic wall, which is to be understood to mean a wall of translucent crystalline metal oxide or translucent metal nitrides like AlN (see also above). According to the state of the art, these ceramics are well suited to form translucent discharge vessel walls of vessel 3. Such translucent ceramic discharge vessels 3 are known, see for example EP215524, EP587238, WO05/088675, and WO06/046175. In a specific embodiment, the discharge vessel 3 comprises translucent sintered $Al_2O_3$, i.e. wall 30 comprises translucent sintered $Al_2O_3$. In the embodiment schematically depicted in the Figures, wall 30 may also comprise sapphire.

The discharge space 11 preferably contains Hg (mercury) and a starter gas such as Ar (argon) or Xe (xenon), as known in the art.

In principle, the lamp of the invention may also be operated free of mercury, but Hg is present in the discharge vessel 3 in the preferred embodiments. During steady-state burning (herein also indicated as nominal operation), long-arc lamps in general have a pressure of a few bar, whereas short-arc lamps may have pressures in the discharge vessel of up to about 50 bar.

Nominal operation in this description means operation at the maximum power and under conditions for which the lamp has been designed to be operated.

The discharge vessel 3 is filled with the filling (i.e. starter gas, filling and Hg) using techniques known in the art.

Optionally, one or more other iodides, as described herein, may in addition be present in the discharge vessel 3 (see also above). The filling may also comprise other elements, as mentioned above. Further, the filling may also comprise substantially only sodium and mercury, or substantially only sodium, as metal elements in the case of HPS lamps.

Figure 4A:
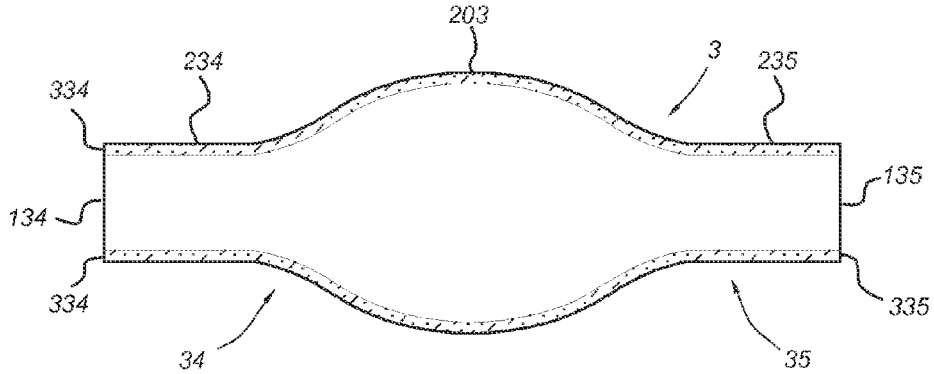
FIGS. 4*a*-4*d* show in more detail some principles of the invention.

FIG. 4*a* schematically depicts an embodiment of the discharge vessel 3. Here, the discharge vessel 3 has the shape of the discharge vessel of FIG. 3, but this shape is only chosen by way of example.

The discharge vessel has an external surface 203, related to the external surface of the broadened part of the discharge vessel 3; the end plugs 34, 35 have respective external surfaces 234 and 235. In general, the total external surface of the discharge vessel will be the sum of the external surface 203 and the external surfaces 234 and 235 of the end plugs 34, 35. The end plugs 34, 35 have openings 134 and 135, respectively. FIG. 4*a* schematically depicts a state wherein current lead-through conductors 20, 21 are not yet arranged in the end plugs 34, 35, respectively, and the openings 134, 135 are not sealed. The edges of the respective end plugs 34, 35 are indicated with references 334, 335 (i.e. first and second end plug edges 334, 335, respectively).

Figure 4B:
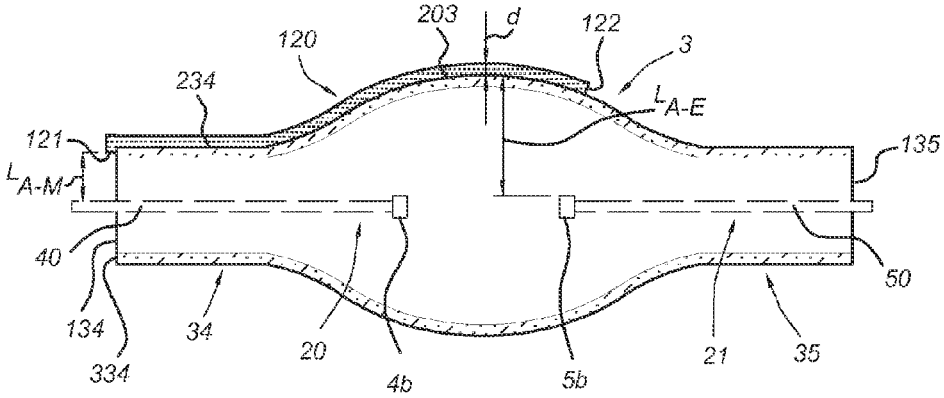

FIG. 4*b* schematically depicts the same embodiment as schematically depicted in FIG. 4*a* (again the shape being only exemplary), wherein for reasons of understanding the current lead-through conductors 20, 21 and electrode tips 4*b*, 5*b* are indicated with dashed lines. Here, the external electrical antenna 120 is indicated. This antenna 120 extends over at least part of the external surface 203 of the ceramic discharge vessel 3 and over at least part of external surface 234 of first end plug 34 (including edge 334). The antenna has a first end 121 at the first end plug 34 and close to the first current lead-through conductor 20 (when arranged in the first end plug), and a second end 122, which is closer to the tip 5*b* of the second electrode than to the tip 4*b* of the first electrode. The width of the antenna 120 is in general in the range of about 0.05-2 mm, such as 0.1-1 mm; the thickness (indicated with reference d) of the antenna 120 is in general in the range of about 0.01-1 mm; the length of the antenna between the first end 121 and the second end 122 may depend upon the type and design of the lamp. The shortest distance between the first end 121 and the first current lead-through conductor 20 (i.e. its metal portion 40), when arranged and sealed into the discharge vessel 3 (see also below), is indicated with $L_{A-M}$, and is in general in the range of about 0.1-5 mm; the shortest distance between the second end 122 and the second electrode tip 5*b* may be in the range of about 0.85-8 mm. Here, the first end 121 and the second end 122 are not similar, in the sense that the former is in electrical contact with the first current lead-through conductor 20, whereas the latter is not in electrical contact with the second current lead-through conductor 21. Between the second end 122 and the second electrode tip 5*b*, the discharge may be formed in the ignition stage of the discharge lamp 1.

Figure 4C:
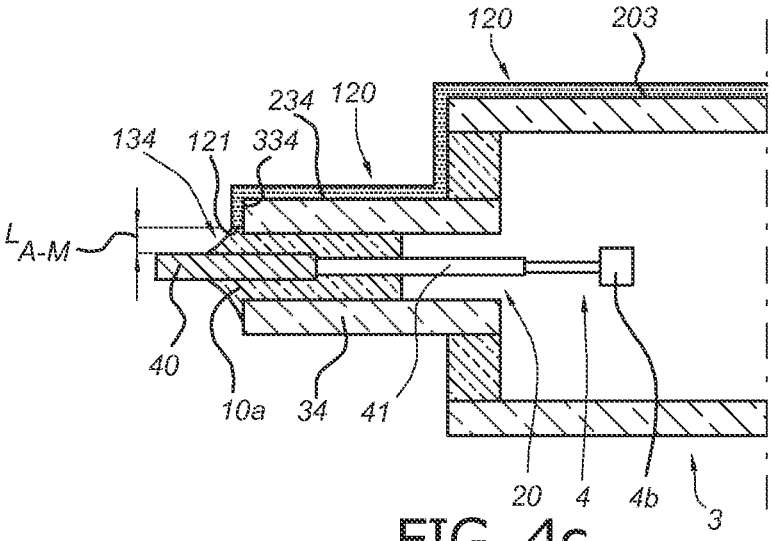

FIG. 4*c* schematically depicts substantially the same embodiments as schematically depicted in FIGS. 4*a* and 4*b*, with focus on the side of the discharge vessel where the first end 121 of the antenna 120 is located (i.e. here at first end plug 34). However, now a more angular shape of the discharge vessel 3 is displayed. Further, the presence of the first current lead-through conductor 20 and the first seal 10*a* is indicated. As shown in these Figures, the antenna 120 may extend on the edge 334 of the first end plug 34. The electrical resistance of the first sealing glass 10*a* between the first end 121 of the electrical antenna 120 and the first metal portion 40 of the first current lead-through conductor 20 is preferably <100 kΩ.

Figure 4D:
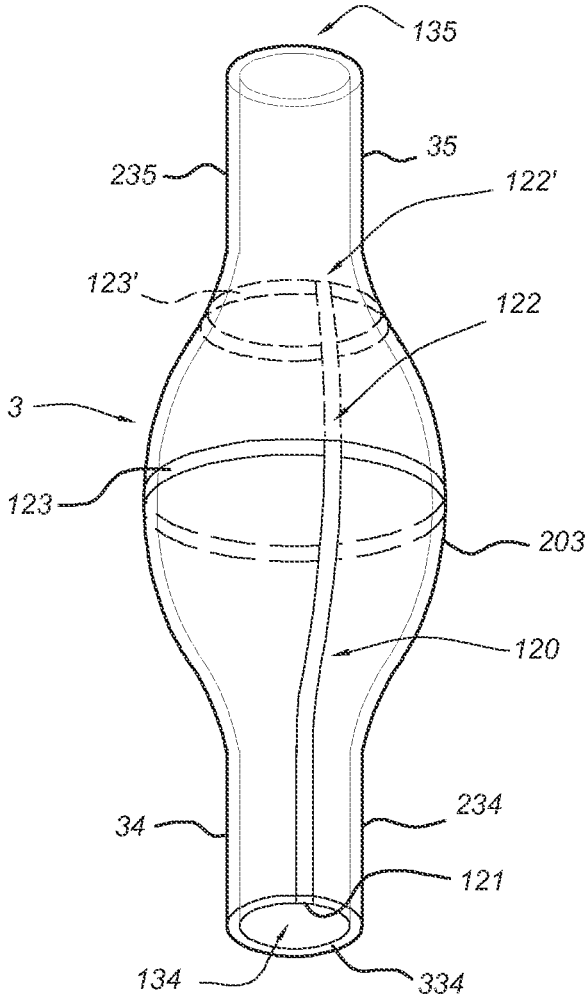

FIG. 4*d* schematically depicts an embodiment wherein the antenna 120 further comprises a circumferential part 123, preferably arranged at the second end 122 of the antenna, thereby circumferentially surrounding (at the external surface 203 of the discharge vessel 3) the second electrode 5, especially the second electrode tip 5*b*. Where U.S. Pat. No. 5,541,480 may use two such rings, one at the first electrode (tip) and one at the second electrode (tip), here only one such circumferential part (such as at the second electrode (tip)) side suffices, since the first end 121 is in electrical connection with the first electrode 4 (i.e. with the first current lead-through conductor 20). The circumferential part 123 is closer to the second electrode tip 5*b* than to the first electrode tip 4*b*, but is not necessarily arranged at a distance closest to the second electrode tip 5*b*. For instance, the circumferential part 123 may also be arranged close to the beginning of the second end plug 35; this is indicated in the Figure with a second dashed structure (indicated with reference 123'; reference 122' refers to the second end of this variant on the circumferential part).

The circumferential part 123 may (thus) extend, in an embodiment, at an axial location of the second electrode and be in contact with the antenna 120. The circumferential part 123 is in this embodiment in fact part of the antenna 120. The circumferential part 123 preferably completely surrounds the discharge vessel 3 (at the latitude of the second electrode tip 5*b*), i.e. a 360° ring, but may optionally partly surround the discharge vessel 3. Preferably, the circumferential part 123 surrounds the external surface 203 in a range of 180-360°, especially 270-360°, more especially 360°. The circumferential part 123 may have a width and height in the same ranges as indicated above for the antenna 120. The circumferential part 123 may together with the rest of the antenna 120 be sintered as described above (see also U.S. Pat. No. 5,541,480).

Note that the specific embodiments depicted in FIGS. 4*a*-4*d* may equally be used for differently shaped discharge vessels 3. Further note that the indications "first" and "second" are in general only used to distinguish between otherwise similar items, unless indicated otherwise.

Figure 5A:
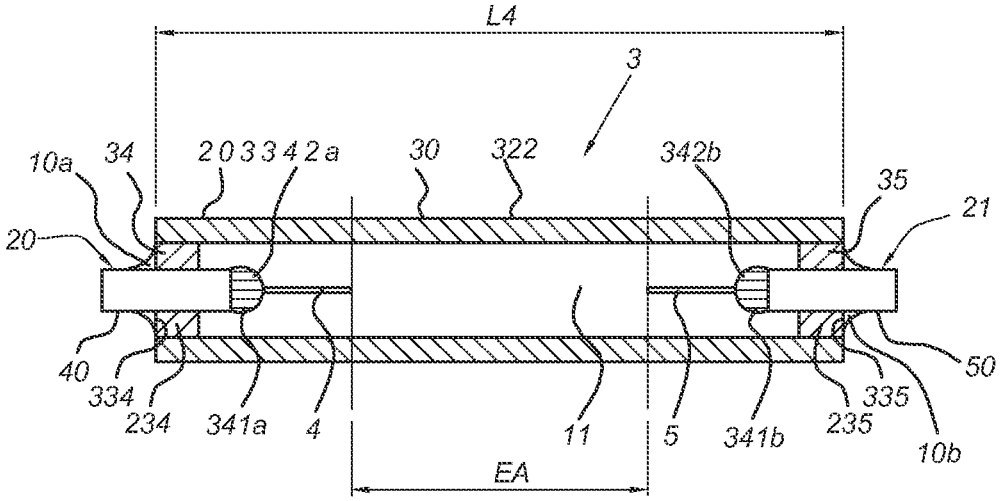
FIGS. 5*a* and 5*b* show in more detail an embodiment of a HPS discharge vessel.

FIG. 5*a* schematically depicts an embodiment of a discharge vessel 3 of a HPS lamp. In principle, the discharge vessel of a HPS lamp may be as described in U.S. Pat. No. 5,510,676, which is incorporated herein by reference. FIG. 5*a* shows an elongate discharge vessel 3 with ends 34, 35. The discharge vessel 3 may be circularly cylindrical and may have an internal diameter of for instance 0.40 cm. Alternatively, for example, the discharge vessel 3 may narrow towards the ends 34, 35. The discharge vessel 3 is especially made of a ceramic material. The sealing glasses are indicated with references 10*a*, 10*b*.

A pair of electrodes 4, 5 is arranged in the discharge vessel 3, wherein each electrode 4, 5 may be fixed with (titanium) solder 341*a*, 341*b* to an end 342*a*, 342*b* of current lead-through conductors 40, 50, for example in the form of niobium tubes, which serve as current supply conductors 20, 21 and which issue to the exterior at ends or plugs 34, 35 of the discharge vessel 3. Alternatively, for example, the current lead-through element(s) may be rod(s).

A central portion 322 of the discharge vessel 3 with for instance a length EA of 4.2 cm extends up to the electrodes 4, 5. The central portion 322 of the discharge vessel 3 may accordingly have a volume V of 0.53 $cm^3$.

In an embodiment, the discharge vessel 3 may be provided with a filling of an amalgam comprising 0.18 mg sodium and 1.42 mg mercury. The relation mercury/volume may be as described in US.

The vessel 3 has an external length L4.

Figure 5B:
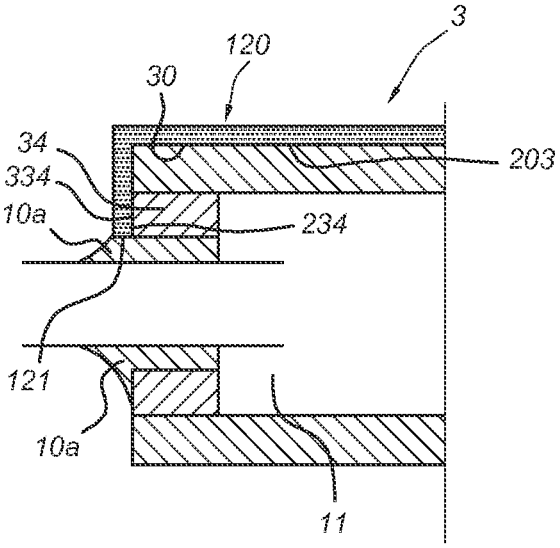

FIG. 5*b* schematically depicts, in more detail, one end, the first end, of the discharge vessel 3 of the HPS lamp. Over part of external surface 203 of the discharge vessel 3 and part of the external surface 234 of the first end plug 34, the antenna 120 is arranged. This antenna 120 is arranged with first end 121 in sealing glass 10*a*.

EXAMPLES

The active antenna has been tested on HPS lamps. The strongest benefit was observed for the Hg-free HPS lamp range. In these lamps a relatively long and narrow arc tube is needed to generate a large enough lamp voltage in the absence of Hg. However, this causes a relatively high ignition voltage. To achieve reliable ignition on ignitors with minimum pulse, the Xe pressure is kept low. A drawback of this low Xe pressure is a 5 to 10% reduction in efficacy, which makes the lamps less attractive compared to their Hg containing counterparts. The Tables below give the results obtained for 2 Hg-free HPS lamp types:

| | 150 W | 400 W | |
|---|---|---|---|
| Vessel outer diameter (substantially tubular shaped) | 5.88 | 8.02 | mm |
| Length (L4) | 94 | 140 | mm |
| Wall thickness | 1.04 | 1.00 | mm |
| Antenna track thickness | 0.25 | 0.25 | mm |
| Na | 2 | 5 | mg |
| Xe | 130 | 120 | Torr |

As regards these lamps, the average ignition voltage is measured for lamps with a passive and an active antenna, and at several different Xe pressures. The results are given in the next Table. Said next Table gives the ignition voltage and the efficacy for 150 W and 400 W Hg-free lamps at a variable Xe pressure. The minimum ignition voltage (in kV) is measured for pulse ignition with a 2 μsec pulse width. Each value is an average of 5 lamps, each measured 3 times. The efficacy is independent of the nature of the antenna and is therefore only given as a function of the Xe pressure.

| 150 W Hg-free | | | | 400 W Hg-free | | | |
|---|---|---|---|---|---|---|---|
| Xe pressure | Ignition voltage | | Efficacy | Xe pressure | Ignition voltage | | Efficacy |
| [Torr] | passive | active | [lm/W] | [Torr] | passive | active | [lm/W] |
| 126 | 2.6 | 1.9 | 97 | 128 | 2.8 | 2.2 | 127 |
| 198 | 2.9 | 2.1 | 101 | 210 | 4.3 | 3.0 | 132 |
| 265 | 4.1 | 2.6 | 105 | 291 | >4.5 | 3.3 | 135 |

The 150 W Hg-free lamp must ignite on a 2.8 kV pulse. With a passive antenna only the series with 126 Torr Xe would meet this requirement. With an active antenna even lamps with 265 Torr Xe meet the ignition requirement. As a consequence of this higher Xe pressure, this lamp can reach a 8 lm/W higher efficacy (an increase of 8%). With respect to the 400 W Hg-free lamps, they must ignite on a 3.2 kV pulse, but otherwise the outcome is the same. The 3.3 kV measured at 291 Torr Xe is slightly too high, but from interpolation of the data it follows that 270 Torr Xe is feasible.

Example(s) of Suitable Sealings

A suitable sealing glass may have the following approximate composition: 70-90 wt. % $12CaO*7Al_2O_3$, 10-20 wt. % $BaO*Al_2O_3$, 2-10 wt. % MgO and 0.5-4 wt. % $BaO*B_2O_3$.

Another suitable sealing glass may have the following approximate composition: 20-40 mol % $Al_2O_3$, 20-40 mol % $Dy_2O_3$ and 30-40 mol % $SiO_2$.

The term "substantially" used herein, such as in "substantially all emission" or in "substantially consists", will be understood by the person skilled in the art. The term "substantially" may also include embodiments with "entirely", "completely", "all", etc. Hence, in embodiments the adverb substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

The lamps described herein are amongst others described during operation. As will be clear to the person skilled in the art, the invention is not limited to methods of operation or lamps in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The use of the verb "to comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware.

The mere fact that certain measures are recited in mutually different dependent claims does not indicate that a combination of these measures cannot be used to advantage.

The invention claimed is:

1. A high intensity discharge lamp, comprising a ceramic discharge vessel having sealed first and second end plugs and an external electrical antenna, wherein a. The discharge vessel encloses a discharge volume, comprises first and second electrodes, and contains a filling;

b. the end plugs enclose first and second current lead-through conductors, which current lead-through conductors are in electrical contact with the electrodes, and which current lead-through conductors comprise first and second metal portions extending to the exterior of the ceramic discharge vessel through first and second end plug openings;

c. the end plug openings are sealed with first and second sealing glasses enclosing at least part of the metal portions;

d. the external electrical antenna extends over at least part of the external surface of the ceramic discharge vessel and over at least part of external surface of first end plug, wherein the shortest distance ($L_{A-M}$) between a first end of the electrical antenna and the first metal portion is in the range of 0.1-5 mm, and wherein the electrical resistance of the first sealing glass between the first end of the electrical antenna and the first metal portion is <100 kΩ.

2. The high intensity discharge lamp according to claim 1, wherein the first metal portion comprises niobium.

3. The high intensity discharge lamp according to claim 1, wherein the electrical antenna comprises a tungsten track.

4. The high intensity discharge lamp according to claim 1, wherein the first sealing glass comprises an aluminum oxide dysprosium oxide silicium oxide glass.

5. The high intensity discharge lamp according to claim 1, wherein the first sealing glass comprises a barium oxide magnesium oxide aluminum oxide glass.

6. The high intensity discharge lamp according to claim 1, wherein the shortest distance ($L_{A-M}$) between the first end of the electrical antenna and the first metal portion is in the range of 0.1 to 3 mm.

7. The high intensity discharge lamp according to claim 1, wherein the electrical resistance of the first sealing glass between the first end of the electrical antenna and the first metal portion is in the range of 1 Ω to 50 kΩ.

8. The high intensity discharge lamp according to claim 1, wherein the high intensity discharge lamp is a high pressure sodium lamp and wherein the filling comprises sodium, wherein the discharge vessel further comprises xenon, and wherein the xenon pressure is at least 250 Torr.

9. The high intensity discharge lamp according to claim 1, wherein the high intensity discharge lamp is a high pressure metal vapour halide lamp and wherein the filling comprises sodium, thallium, calcium and optionally one or more elements selected from the group of rare earth metals, scandium, yttrium, lithium, gallium, aluminum, indium, zinc, and tin.

10. The high intensity discharge lamp according to claim 1, wherein the high intensity discharge lamp is a high pressure metal vapour halide lamp and wherein the filling comprises at least one element from each group a) alkali metal halides, b) indium and/or thallium halide, and c) rare earth metal halides, and optionally d) one element from the group of alkaline earth metal halides.

11. The high intensity discharge lamp according claim 1 having a correlated color temperature in the range of 2500-4500 K.

12. The high intensity discharge lamp according to claim 8, wherein the xenon pressure is not greater than 600 Torr.

* * * * *